US005878897A

United States Patent [19]

Lazzaro et al.

[11] Patent Number: 5,878,897

[45] Date of Patent: Mar. 9, 1999

[54] SLACK REDUCED LOCK MEMBER FOR A TYPE E RAIWAY COUPLER

[75] Inventors: Frank Lazzaro; Peter Scott Mautino, both of Verona; Jeffrey D. Wurzer, Glenshaw; MaryAnn Glover; Alvin G. Hurt, both of Pittsburgh, all of Pa.

[73] Assignee: McConway & Torley Corporation, Pittsburgh, Pa.

[21] Appl. No.: 708,312

[22] Filed: Sep. 4, 1996

[51] Int. Cl.[6] ..... B31G 3/04

[52] U.S. Cl. ..... 213/139; 213/75 R; 213/145

[58] Field of Search ..... 213/75 R, 109, 213/139, 140, 141, 142, 143, 144, 145, 146, 147, 148, 149

[56] References Cited

U.S. PATENT DOCUMENTS 2,334,034 11/1943 Richards ..... 213/188

4,084,705 4/1978 Pshinsky et al. ..... 213/145

OTHER PUBLICATIONS

"Mechanics of Materials", Beer et al, McGraw Hill Book Company, pp. 173–174, 1981.

*Primary Examiner*—S. Joseph Morano

*Attorney, Agent, or Firm*—James Ray & Associates

[57] ABSTRACT

A lock member for a Type E railway freight car coupler formed of an as-cast and austempered ductile iron casting, having a slightly over-sized head portion, the as-cast and austempered ductile iron casting having a minimum tensile strength of about 140 ksi, a minimum yield strength of about 110 ksi, a minimum elongation in 2 inches of about 4%, and a BHN of about 321–388.

13 Claims, 8 Drawing Sheets

SLACK REDUCED LOCK MEMBER FOR A TYPE E RAIWAY COUPLER

FIELD OF THE INVENTION

The present invention relates, in general, to railway type coupler lock members and, more particularly, this invention relates to a new and improved Type E railway coupler lock member which is not only stronger than prior art coupler lock members of the same type, but is also significantly lighter in weight which contributes to fuel savings, and can be manufactured to much closer tolerances to significantly reduce intercomponent slack within the coupler, which also contributes not only to fuel savings, but serves to reduce damage to rolling stock and lading and enhances the over-all life of the equipment. Still more particularly, this invention relates to a new and improved Type E railway coupler lock member that can be produced with a high-strength, low-alloy, austempered ductile iron which is castable to much closer tolerances thereby permitting as-cast head portion dimensions slightly larger than those specified by the American Association of Railroads, which contributes significantly to the slack reduction, and because of the greater strength readily permits redesign of the lock member to eliminate unnecessary mass and reduce the weight thereof.

BACKGROUND OF THE INVENTION

With ever increasing fuel costs, there is a concerted effort in the railroad industry to increase productivity. Historically, such increases have been achieved by increasing rolling stock in a train consist and additionally the capacity of the rail cars themselves. However, the practical load limit of today's track system has generally been reached so that attention is now being directed in other areas, such as, lightening the weight of rolling stock, which includes the substitution of newer, lighter weight materials where possible without sacrificing strength or unreasonably increasing costs.

In addition, practical train lengths and practical speeds at which train traffic can operate in a relatively safe manner have been reached without improvement in stability and ride quality. Hence, basic equipment designs are being reevaluated not only to lighten weight, but to improve performance, stability and ride quality, such as by reducing slack that has been common in most coupling designs.

Although minor improvements may seem trivial, the over-all benefits to be achieved can be significant, especially when it is realized that in 1994, for example, the North American railroad industry transported about 1.2 trillion ton-miles of lading in a fleet of 1.5 million cars, with an annual revenue of $31 billion. Even as to individual trains, it is apparent that in a train consist made up of 100 cars, a 4-pound reduction per coupler, translates into an 800 pound reduction per train, and a ⅛-inch reduction in slack per coupler will translate into an over-all slack reduction of more than two feet throughout the 100 car train.

In 1932, the Type E coupler was adopted by the ARA, American Railway Association (predecessor to the AAR, Association of American Railroads) as the standard coupler for railway type freight cars. Although modified periodically since then to meet changing requirements imposed by changing demands, and other coupler designs have been developed for special applications, the Type E coupler is today still the standard coupler for freight type service. As the standard coupler, all of the producers of such couplers in the United States are expected to produce the coupler to the standard specification, so that such couplers are completely interchangeable regardless of the manufacturer.

The Type E coupler is well known to those knowledgeable in the trade as having a pivotal, vertical-knuckle adapted to engage a like vertical-knuckle on an adjacent coupler, so that when the couplers are brought into contact with each other, the two knuckles are pivoted into an interlocking, engaging position. Each coupler includes a gravity activated, coupler lock member adapted to slide downwardly after coupler engagement to virtually lock each knuckle at its engaged position.

To permit the coupler to become disengaged, each coupler lock member must be raised within its slide-channel, so that a draft load on the couplers will tend to pull the cars apart which causes the knuckles to pivot away from each other and thereby become disengaged.

The Type E railway coupler further includes a cast steel coupler head at the forward end extending from a shank adapted to be attached to a yoke, which secures the coupler to the railway car. The forward end of the coupler head is generally V-shaped in horizontal cross-section with the above-described vertical-knuckle vertically pinned at one leg of the "V", and adapted to engage an identical vertical-knuckle on an adjacent car, as above-described.

The vertical-knuckle, adapted for pivotal movement about a vertical pin, is generally hook shaped in section, having a front face, a nose, a throat, and a pulling face at the forward end, and an arcuate tail mass at the back end adapted to be pivoted within a mating, arcuate channel within the coupler head along with pivotal movement of the knuckle.

The coupler lock includes a sliding lock member having an exceptionally complex configuration including a leg extending downwardly from a lock-head portion with the lock head portion disposed for vertical sliding motion within a vertical channel within the coupler head, such that the lock-head portion of the lock member, when moved to its lower-most position, will lie in the path of the tail portion of the knuckle, thereby preventing the coupler knuckle from being pivoted to the open position.

Only by slidably repositioning the coupler lock member upwardly, with the head portion moved away from the knuckle, can the knuckle be pivoted to the open position, such that the tail portion of the coupler knuckle will be free to pivot under the lock-head. These and other operating parts of the Type E railway coupler are well known to those persons familiar with the art and have been since 1932, so that a further detailed description is not believed to be necessary here.

It is however noted, that while the lock member is normally used in its as-cast condition, the coupler lock is required by AAR specifications to be manufactured of cast or forged steel to the dimensions illustrated in FIGS. 7–12 of the attached drawings. Because the coupler head, knuckle and lock member are utilized in their as-cast or as-forged condition, the specification tolerances have to assure a sufficiently loose fitting so that the components will function as intended without any binding, and as a result, a considerable degree of slack is naturally incorporated.

While machining to closer tolerances would essentially eliminate a considerable degree of the slack, it should be readily apparent that the rather complicated forms of the three components are such that the cost of machining would be excessive and prohibitive.

SUMMARY OF THE INVENTION

This invention is predicated on the development of a new and improved Type E coupler lock member with improved operating characteristics and lower cost which, although modified in material and dimensions, retains its required interchangability characteristics. The new and improved lock member of this invention is not only stronger than prior art locks members of the same type, but it is also significantly lighter in weight which contributes to fuel savings, and can be manufactured to much closer tolerances in order to significantly reduce the intercomponent slack. Such slack reduction contributes not only to fuel savings, but serves to reduce damage to rolling stock and lading and enhances the over-all life of the railway equipment. In essence, the lock member of this invention is produced of a high-strength, low-alloy, austempered ductile iron which in an as-cast condition will have head portion dimensions slightly larger than those specified by the American Association of Railroads. The slightly larger dimensions on the head portion contributes significantly to the slack reduction, and because the austempered ductile iron has a greater strength than the as-cast steel of the prior art, the inventive lock member readily permits redesign thereof to eliminate and minimize unnecessary mass and reduce the weight thereof and reduce the amount of material required in its manufacture. Specifically, because the base material is stronger cut-away portions can be designed into the lock member to further enhance weight and material reduction without any sacrifice in strength and safety.

OBJECTS OF THE INVENTION

Accordingly, a primary object of the present invention is to provide a new and improved Type E railway coupler lock member which will exhibit significantly reduced slack as compared to the Type E coupler locks presently being used.

Another object of the present invention is to provide an improved Type E railway coupler lock member which is stronger than the Type E coupler locks presently being used.

A further object of the present invention is to provide an improved Type E railway coupler lock member which is lighter in weight than the Type E coupler locks presently being used.

An even further object of the present invention is to provide an improved Type E railway coupler lock member which is made of a stronger base material which thereby permits cut-away portions to be designed into the lock member to enhance weight and material reduction essentially without sacrificing strength and safety.

A still further object of the present invention is to provide an improved Type E railway coupler lock member which is made of a stronger base material, namely a high strength, low alloy, austempered ductile iron, which is castable to closer tolerances thereby permitting a head portion having slightly larger dimensions to reduce slack, and because of the metal's higher strength permits cut-away portions to be designed into the lock member to reduce weight and material without sacrificing strength and safety.

In addition to the above-described objects and advantages of the coupler lock member of this invention, various other objects and advantages of the present invention will become more readily apparent to those persons who are skilled in the same and related arts from the following more detailed description of the invention, particularly, when such description is taken in conjunction with the attached drawing figures and with the appended claims.

Figure 1:
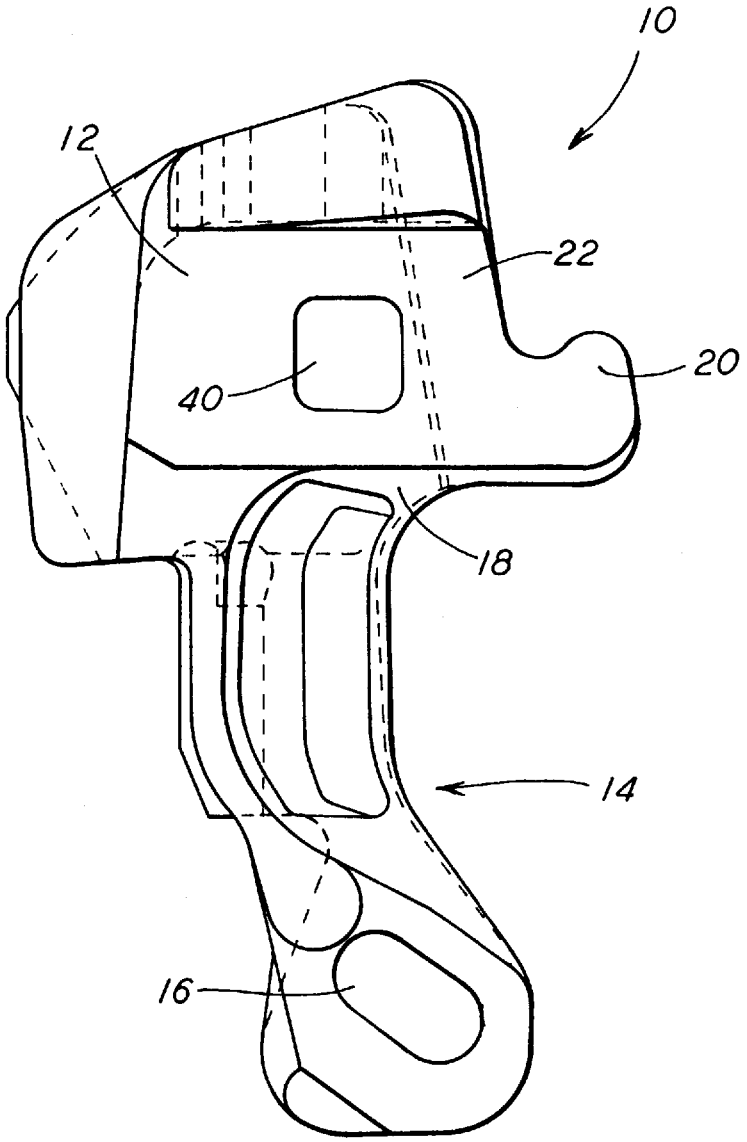
FIG. 1 is a right-side elevational view of a Type E coupler lock member according to a presently preferred embodiment of this invention.
Figure 2:
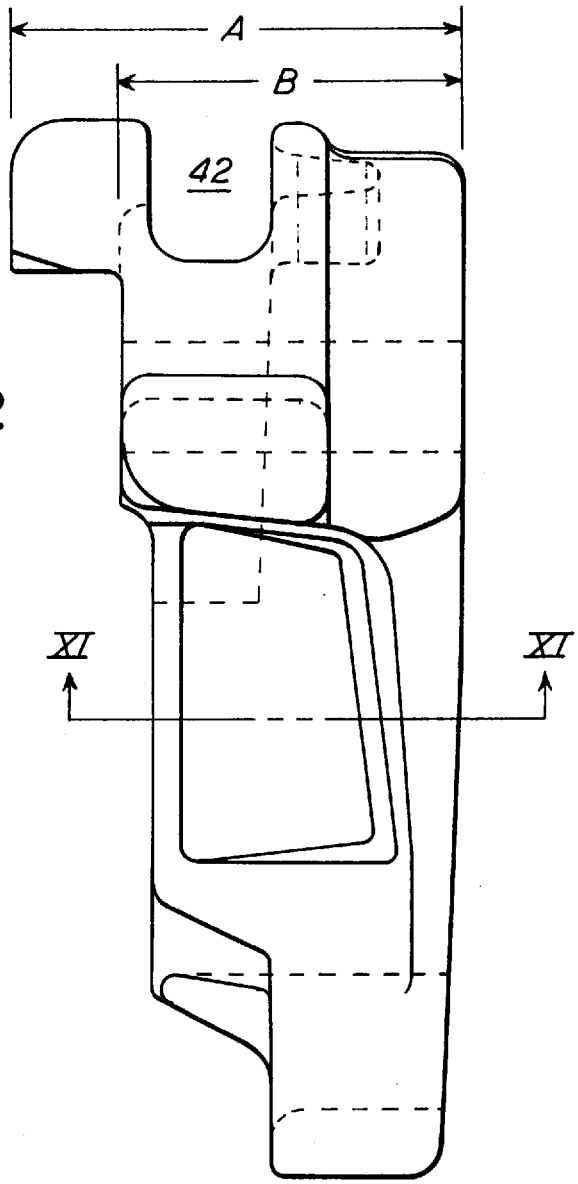
FIG. 2 is a front elevational view of the Type E coupler lock member shown in FIG. 1.

BRIEF DESCRIPTION OF THE PRESENTLY PREFERRED AND VARIOUS ALTERNATIVE EMBODIMENTS OF THE INVENTION

Reference to FIGS. 1–5 will illustrate the presently preferred coupler lock members according to this invention, which, for all intents and purposes looks substantially like those of the prior art, as illustrated in FIGS. 7–12. Indeed, the inventive coupler lock member of this invention, generally designated 10, is interchagable with the lock members of the prior art, and includes a lock head 12, having a leg 14 extending downwardly therefrom.

The lower end portion of the leg 14 is provided with an oval shaped aperture 16, often referred to as a toggle slot, to which a locklift assembly (not shown) is attachable and provides a knuckle shelf seat 18. Such knuckle shelf seat 18 is an arcuate ledge formed under the lock head 12 through which the arcuate tail (not shown) of the vertical knuckle (not shown) can pass when the lock member 10 is disposed upwardly into the unlocked position.

The locklift assembly (not shown) is a mechanism which functions to raise the coupler lock member 10 to permit the uncoupling of two joined railway type freight cars. The lock head 12 includes a fulcrum 20, and a locking face 22 on the right-hand side against which the arcuate tail (not shown) of the vertical knuckle (not shown) abuts when the lock member 10 is disposed downwardly in the lock position. In essence, the lock member 10 of this invention is substantially the same as those of the prior art in order to maintain interchangability, with a first primary difference being that when utilized, the inventive lock member, having been cast with slightly larger dimensions and to closer tolerances, will function better with significantly reduced slack and play, as compared to those lock members of the prior art.

In addition, as a second primary difference, the inventive coupler lock member 10 is stronger and as a result should have a significantly longer service life, and as a third primary difference, the inventive coupler lock member 10 is significantly lighter in weight, particularly in view of the cut-out portions described below, to contribute to both fuel savings and material cost.

More specifically, the coupler lock member 10 of this invention differs firstly from the cast steel coupler locks of the prior art in that the inventive coupler lock member 10 is fabricated of a high strength, low alloy chemistry which is subsequently heat treated to an austempered ductile iron, having a tensile strength of about 140 ksi minimum, a yield strength of about 110 ksi minimum, and elongation in 2" of about 4%, and a BHN within the range of between about 321 and about 388.

Secondly, while the majority of the dimensions of the inventive coupler lock member 10 can be substantially the same as those of the prior art lock members, it is essential in order to gain the slack reduction advantages of this invention, that certain dimensions of the lock head 12 be slightly larger than those of the prior art.

Specifically, with reference to FIGS. 1–5, the inventive coupler lock member 10 is cast to achieve an as-cast dimension "A" which is ideally 4.063±0.015-inches, or at least more than the prior art specified dimension of 4.00 inches; and an as-cast dimension "B" which is ideally 3.063±0.015-inches, or at least more than the prior art specified dimension of 3.00 inches. All other dimensions can and should be substantially the same as those specified by the AAR, as exemplified in FIGS. 6–10.

For rather ideal commercial purposes, the inventive coupler lock members 10 described above are currently produced by Advanced Cast Products, Inc. of Meadville, Pa., for the assignee of this invention, of an austempered ductile iron, it produces and sells under the trademark "CasTuf Grade 2". This particular grade is said to be a heat treated cast ductile iron to which small amounts of nickel, molybdenum or copper has been added to improve the desired hardenability and derive the required strength and hardness properties described above.

More specifically, the presently preferred chemistry of the ductile iron is: carbon, in a range of between about 3.6 and about 3.75 weight %; silicon, in a range of between about 2.4 and about 2.80 weight %; manganese, in a range of between about 0.18 and about 0.35 weight %; molybdenum, in a range of between about 0.14 and about 0.19 weight %; copper, in a range of between about 0.40 and about 0.60 weight %; magnesium, in a range of between about 0.03 and about 0.05 weight %; and sulfur, 0.015 maximum, with the balance, of course, being iron.

After casting, the cast product is heat treated, in which it is first austenitized to dissolve the carbon, i.e., heated to a substantially uniform temperature above the $Ae_3$ temperature, then quenched rapidly enough to avoid formation of pearlite to a temperature in the lower bainite region just above the $M_s$ temperature, and held at that temperature for a time which is at least sufficient to cause transformation to a lower bainite, i.e., austempering to form acicular ferrite precipitate within an austenite matrix.

As in all austempered grades, carbon is rejected into the austenite, so that the resulting microstructure is acicular ferrite in a carbon-enriched austenite, often designated ausferrite.

In order to better control the dimensional limits, it is preferred that the castings be produced by the lost-foam process, wherein polyaryrene or polymethyl methacrylate is shaped into a foam replica of the part, to which foam gating is attached. Loose sand is vibrated therearound to form a mold with gating into which the molten metal is poured. When the molten metal is cast into the mold, the foam is vaporized by the molten metal, and the hot cast metal takes its place to form the casting within the sand mold. The lost-foam method of casting is well known in the foundry arts, and need not be further described here.

Figure 3:
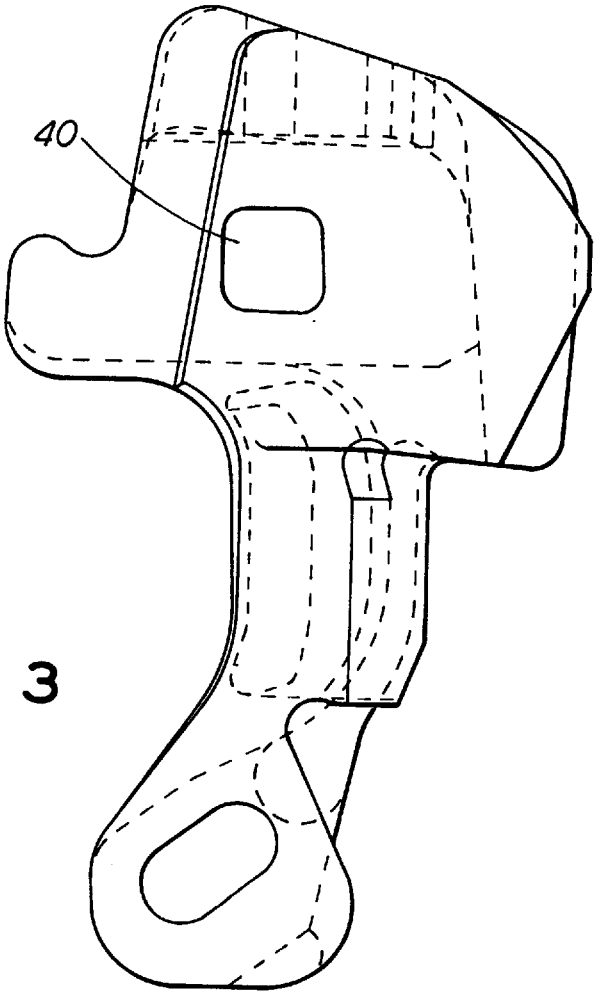
FIG. 3 is a left-side elevational view of the Type E coupler lock member shown in FIGS. 1 and 2.
Figure 5:
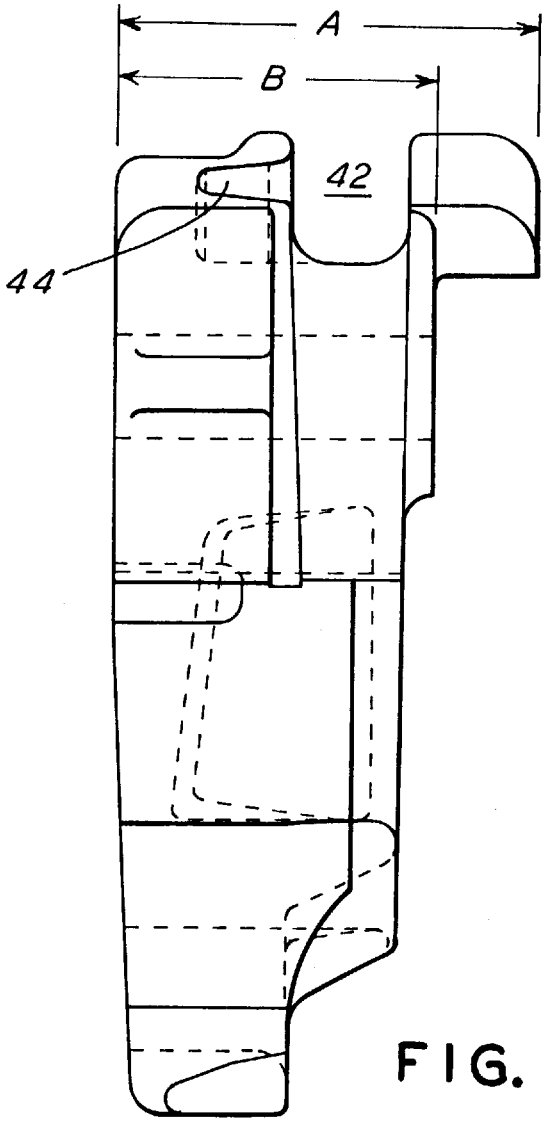
FIG. 5 is a back elevational view of the Type E coupler lock member shown in FIGS. 1, 2, 3, and 4.
Figure 6:
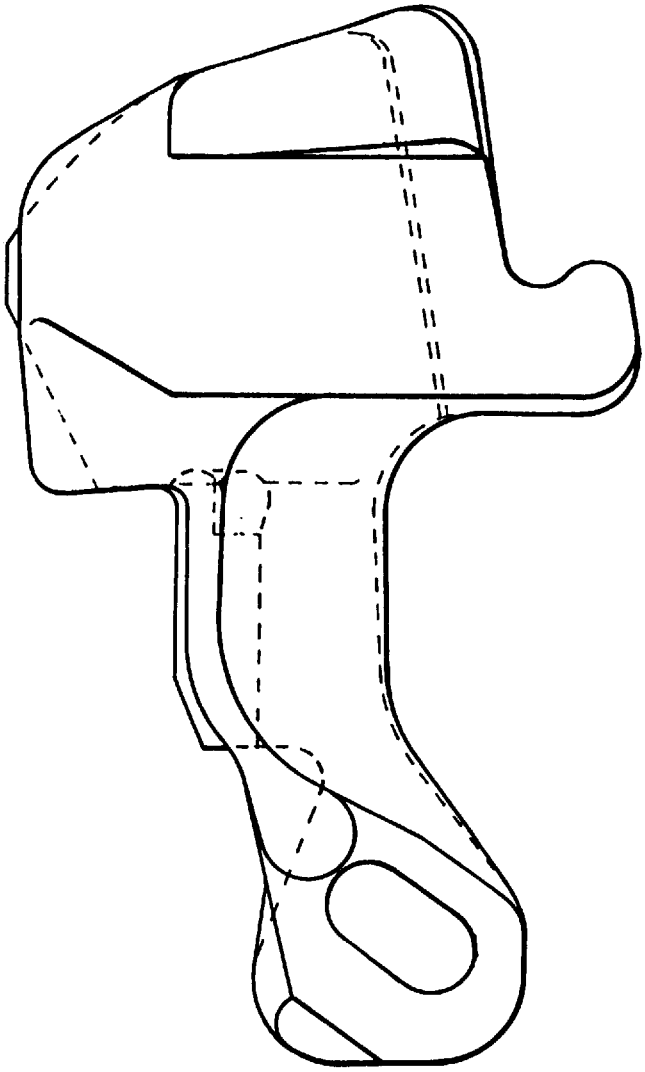
FIG. 6 PRIOR ART
FIGS. 6–10 are substantially the same as FIGS. 1–5 above, respectively, but illustrate the prior art Type E coupler lock member showing most to the AAR specification dimensions thereof.
Figure 7:
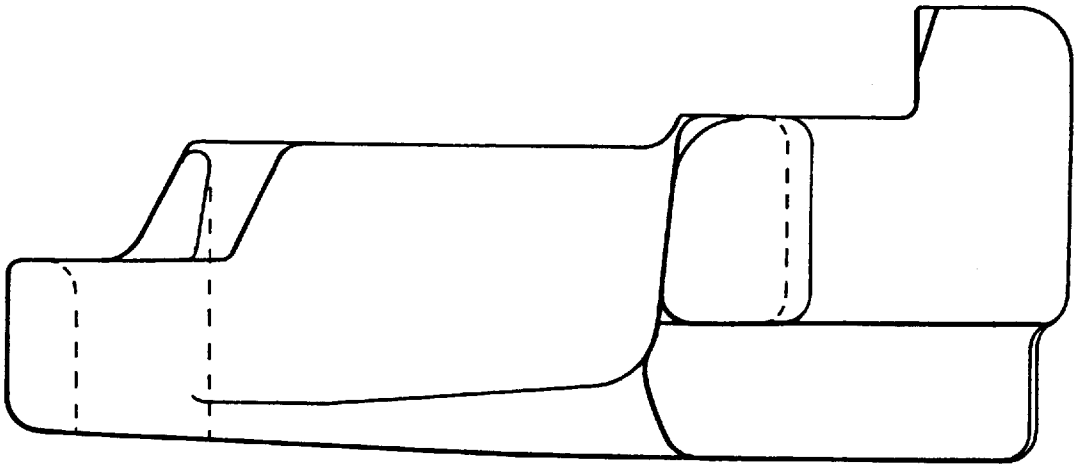
FIG. 7 PRIOR ART
Figure 9:
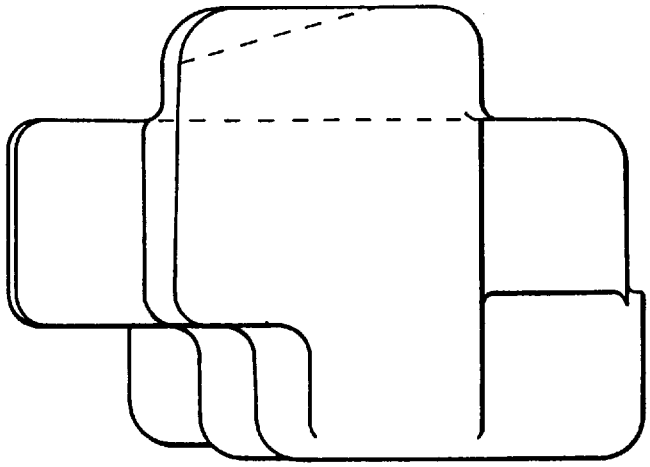
FIG. 9 PRIOR ART
Figure 8:
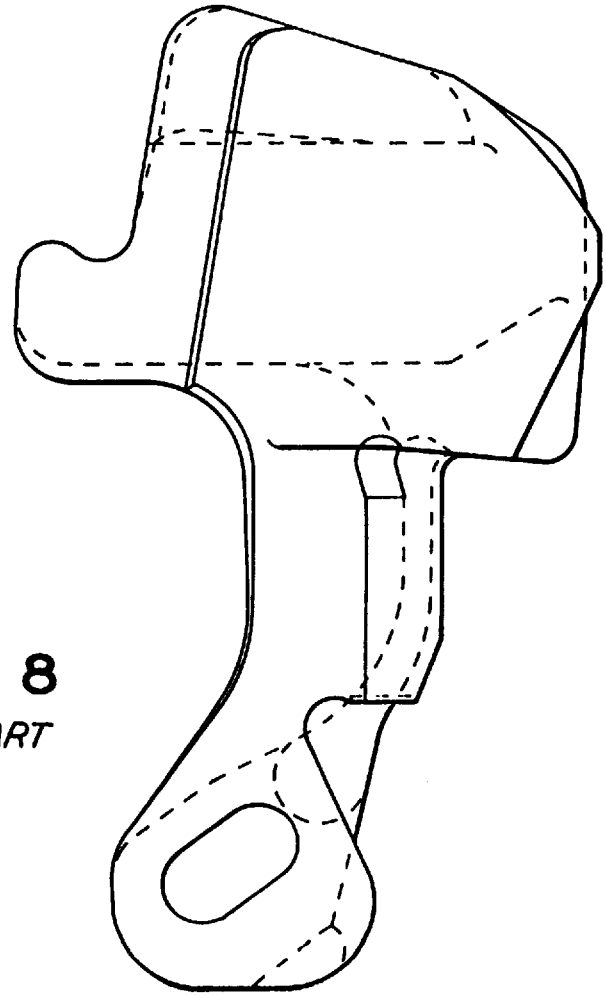
FIG. 8 PRIOR ART
Figure 10:
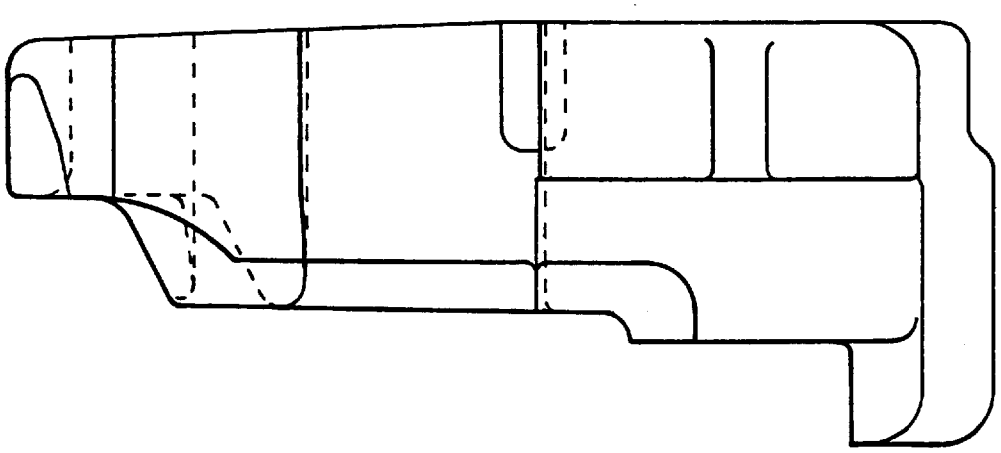
FIG. 10 PRIOR ART

Because of the superior strength of the as-cast and austempered coupler lock member 10, weight reduction by selectively eliminating any unnecessary portions of the casting is readily possible without having an adverse effect on the overall strength and/or life of the coupler lock member 10. Specifically, as shown in FIGS. 1 and 3, a groove or generally U-shaped portion 42 is removed from the top-center of the head portion 12 and which may include a side-indent portion 44.

Because the loading on head portion 12 is primarily compressive and against the left-hand side, the groove or cut-out portion 42 has little adverse effect on the strength of the head portion 12 or the over-all strength of the coupler lock member 10, but yet the inclusion of such a groove or cut-out portion 42 will not only reduce the weight of the coupler lock member 10, but will further serve to reduce the amount of metal necessary to cast such coupler lock member 10.

In a similar manner, a somewhat crescent shaped wedge portion or cut-out portion 46 is preferably formed within the leg portion 14, for the same reasons and for the same beneficial result. The leg portion 14 provides an extension intermediate the lock head 12 and the locklift assembly (not shown) whereby the locklift assembly can lift the coupler lock member 10 to the unlock position. Accordingly, the only resistive force acting against the lock lift assembly is the weight of the coupler lock member 10, and the associated frictional forces, so that the cut-out portion 46 does not adversely reduce the strength to the coupler lock member 10 or leg portion 14 to any detrimental extent.

While the two above described cut-out portions are included within the presently preferred embodiment of this invention, additional cut-out portions can be included if additional weight reduction is desired. For example, a generally rectangular aperture or cut-out portion 40 can be formed horizontally through head portion 12. Because the loading on head portion 12 is primarily compressive, the aperture or cut-out portion 40 will have little adverse effect on the strength of the head portion 12 or the over-all strength of the coupler lock member 10, but yet the inclusion of such additional cut-out portions will further serve to further reduce the weight of the coupler lock member 10, as well as reduce the amount of metal necessary to cast such coupler lock member 10.

Figure 11:
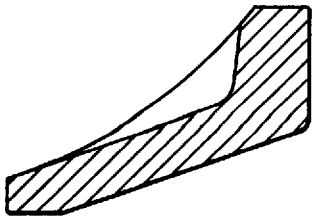
FIG. 11 is a cross-sectional view of the leg portion of the lock member shown in FIGS. 1–5 taken at line XI—XI, illustrating a cut-out portion to reduce the mass and weight thereof.
Figure 4:
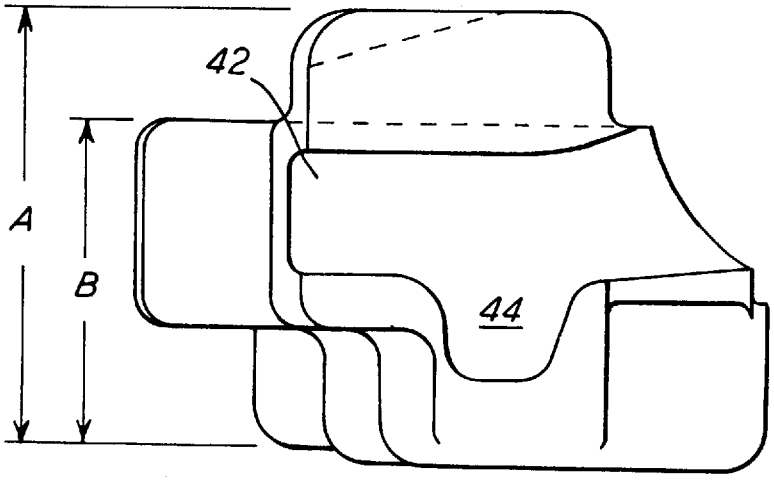
FIG. 4 is a top view of the Type E coupler lock member shown in FIGS. 1, 2 and 3.

Reference to FIG. 11 will illustrate the cross-section of leg portion 14 to better indicate the nature of such cut-out portion 46. As should be apparent, the cut-out portion 42, as well as 40 if incorporated, should be centrally disposed within the body of head portion 12 so that ample metal remains therearound to assure that the head portion 12 is not unduly weakened.

In addition, the intersecting side surfaces of any such aperture or cut-out portion should be sufficiently rounded to eliminate the possibility of having created stress notches or reentrant angles which could adversely affect notch toughness. While only three such cut-out portions have been illustrated and described above, it should be apparent that other such cut-out portions could be included at other locations for the same weight saving purposes, provided such cut-out portions are well designed and placed to assure that the strength of the body where placed is not unduly weakened.

The coupler lock member 10 as illustrated in FIGS. 1–5, weighs 12 pounds, as compared to the 16-pound prior art type coupler lock member as illustrated in FIGS. 6–10. This comprises a significant weight saving and obviously reduces the amount of metal required to cast the part. Despite the reduced amount of material, the inventive coupler lock member 10 has superior strength as compared to the coupler lock members of the prior art.

While one presently preferred embodiment of the coupler lock member of the present invention has been described and illustrated in detail above, it should be apparent to those persons skilled in the art that various other embodiments, adaptations and modifications of the invention could be made without departing from the either the spirit of the invention or the scope of the appended claims, particularly, to the extent of incorporating other cut-out portions for weight saving purposes.

We claim:

1. A lock member for a Type E railway freight car coupler, said lock member comprising: an as-cast and austempered ductile iron casting, having a head portion with an "A" dimension within a range of generally between about 4.00 and about 4.063±0.015 inches and a "B" dimension within a range of generally between about 3.00 and about 3.063±0.015 inches, said as-cast and austempered ductile iron casting further having a minimum tensile strength of generally about 140 ksi and a minimum yield strength of generally about 110 ksi and a minimum elongation in 2 inches of generally about 4% and a BHN within a range of generally between about 321 and about 388.

2. A lock member for a Type E railway freight car coupler, according to claim 1, wherein said "A" dimension of said lock member casting for such Type E railway freight car coupler is 4.063±0.015 inches.

3. A lock member for a Type E railway freight car coupler, according to claim 1, wherein said "B" dimension of said lock member casting for such Type E railway freight car coupler is 3.063±0.015 inches.

4. A lock member for a Type E railway freight car coupler, according to claim 1, wherein said lock member casting for such Type E railway freight car coupler comprises:

| | |
|---|---|
| Carbon | 3.60–3.75 weight %; |
| Silicon | 2.40–2.80 weight %; |
| Manganese | 0.18–0.35 weight %; |
| Molybdenum | 0.14–0.19 weight %; |
| Copper | 0.40–0.60 weight %; |
| Magnesium | 0.03–0.05 weight %; |
| Sulfur | 0.015 Max. weight %; and |
| Balance | essentially iron and other incidental impurities. |

5. A lock member for a Type E railway freight car coupler, according to claim 4, wherein said lock member casting for such Type E railway freight car coupler is austempered by first heating said lock member casting to an austenitizing temperature to dissolve said carbon, then quenched rapidly at a rate which is at least sufficient to avoid formation of pearlite, and held at an austempering temperature to form acicular ferrite within a carbon-enriched austenite.

6. A lock member for a Type E railway freight car coupler, according to claim 1, wherein said lock member casting for such Type E railway freight car coupler is cast by a lost-foam process.

7. A lock member for a Type E railway freight car coupler, according to claim 1, wherein said lock member for such Type E railway freight car coupler includes a groove centrally disposed at a top center surface of said head portion for the purpose of reducing the weight of said lock member for such Type E railway freight car coupler.

8. A lock member for a Type E railway freight car coupler, according to claim 1, wherein said lock member for such Type E railway freight car coupler further includes a leg portion extending from said head portion, said leg portion including a crescent-shaped wedge cut-out portion in a predetermined side face thereof for the purpose of reducing the weight of said lock member for such Type E railway freight car coupler.

9. A lock member for a Type E railway freight car coupler, according to claim 8, wherein intersecting side surfaces of said crescent-shaped wedge cut-out portion are rounded at least sufficient to substantially eliminate creating stress notches and reentrant angles which could adversely affect notch toughness of said lock member for such Type E railway freight car coupler.

10. A lock member for a Type E railway freight car coupler, according to claim 8, wherein said lock member for such Type E railway freight car coupler further includes an aperture disposed horizontally through said head portion for the purpose of reducing the weight of said lock member for such Type E railway freight car coupler.

11. A lock member for a Type E railway freight car coupler, according to claim 10, wherein said aperture disposed horizontally through said head portion of said lock member for such Type E railway freight car coupler is generally rectangular in shape.

12. A lock member for a Type E railway freight car coupler, according to claim 1, wherein said lock member for such Type E railway freight car coupler has a weight of generally about 10 pounds.

13. A lock member for a Type E railway freight car coupler, according to claim 1, wherein said lock member for such Type E railway freight car coupler will generally provide about a ⅛-inch reduction in slack per coupler while retaining all required angling capability for such Type E railway freight car coupler.

* * * * *

UNITED STATES PATENT AND TRADEMARK OFFICE

CERTIFICATE OF CORRECTION

PATENT NO. : 5,878,897

DATED : March 9, 1999

INVENTOR(S) : Frank Lazzaro, et al.

It is certified that error appears in the above-identified patent and that said Letters Patent is hereby corrected as shown below:

Column 1, line 22, after "reduction" delete ",".

Column 1, line 22, after "and" insert --,--.

Column 1, line 22, after "strength" insert --,--.

Column 1, line 35, after "materials" insert --,--.

Column 1, line 36, after "possible" insert --,--.

Column 1, line 61, delete "and".

Column 3, line 4, change "locks" to --lock--.

Column 3, line 22, after "stronger" insert --,--.

UNITED STATES PATENT AND TRADEMARK OFFICE

CERTIFICATE OF CORRECTION

PATENT NO. : 5,878,897

DATED : March 9, 1999

INVENTOR(S) : Frank Lazzaro, et al.

It is certified that error appears in the above-identified patent and that said Letters Patent is hereby corrected as shown below:

Column 3, line 51, after "slack" delete ",".

Column 3, line 51, after "and" insert --,--.

Column 3, line 52, after "strength" insert --,--.

Column 4, line 53, after "and" insert --,--.

Column 6, line 24, change "above described" to --above-described--.

Signed and Sealed this

Eleventh Day of May, 1999

*Attest:*

*Attesting Officer*

Q. TODD DICKINSON

*Acting Commissioner of Patents and Trademarks*